US008864504B1

(12) United States Patent
Gretz

(10) Patent No.: US 8,864,504 B1
(45) Date of Patent: Oct. 21, 2014

(54) INTERSYSTEM GROUNDING CLAMP WITH SERRATED GRIPPING SURFACES AND A PLURALITY OF GROUNDING TERMINALS

(75) Inventor: Thomas J. Gretz, Port St. Lucie, FL (US)

(73) Assignee: Arlington Industries, Inc., Scranton, PA (US)

( * ) Notice: Subject to any disclaimer, the term of this patent is extended or adjusted under 35 U.S.C. 154(b) by 115 days.

(21) Appl. No.: 13/492,892

(22) Filed: Jun. 10, 2012

(51) Int. Cl.
*H01R 4/66* (2006.01)
*H01R 4/60* (2006.01)

(52) U.S. Cl.
CPC ... *H01R 4/66* (2013.01); *H01R 4/60* (2013.01)
USPC ..... 439/100

(58) Field of Classification Search
CPC ..... H01R 4/30; H01R 4/34; H01R 4/36; H01R 4/60; H01R 4/64; H01R 4/66; H01R 4/643; H01R 11/12; H01R 11/26
USPC ..... 439/100, 798, 92, 804, 806, 810, 814, 439/801
See application file for complete search history.

(56) References Cited

U.S. PATENT DOCUMENTS

| | | | | | |
|---|---|---|---|---|---|
| 440,934 | A * | 11/1890 | Tompkins | 439/801 |
| 2,077,613 | A * | 4/1937 | Bondeson | 439/100 |
| 2,231,325 | A * | 2/1941 | Douglas | 200/257 |
| 2,269,314 | A * | 1/1942 | MacDonald | 439/848 |
| 2,547,932 | A * | 4/1951 | Downs, Jr. | 439/100 |
| 2,551,636 | A * | 5/1951 | Ratigan | 279/112 |
| 2,777,096 | A * | 1/1957 | Weisberg | 361/129 |
| 2,947,967 | A * | 8/1960 | Waldrop | 439/797 |
| 3,041,574 | A * | 6/1962 | Cornell, Jr. | 439/277 |
| 3,058,087 | A * | 10/1962 | Piasecki | 439/100 |
| 3,125,398 | A * | 3/1964 | Wolf | 439/798 |
| 3,133,779 | A * | 5/1964 | Stanback | 439/798 |
| 3,188,602 | A * | 6/1965 | Toedtman et al. | 439/479 |
| 3,380,014 | A * | 4/1968 | Schenker et al. | 439/412 |
| 3,537,150 | A * | 11/1970 | Emberson | 403/344 |
| 3,988,052 | A * | 10/1976 | Mooney et al. | 439/804 |
| 4,057,312 | A * | 11/1977 | Hagermo | 439/431 |
| 4,114,365 | A * | 9/1978 | Matsuura et al. | 368/204 |
| 4,457,577 | A * | 7/1984 | Browne et al. | 439/98 |
| 4,740,174 | A * | 4/1988 | Annas et al. | 439/359 |
| D296,545 | S | 7/1988 | Sachs | |
| 4,776,808 | A * | 10/1988 | Davidson | 439/100 |
| 5,108,296 | A * | 4/1992 | Takano et al. | 439/92 |
| D332,939 | S | 2/1993 | McDonough, Jr. | |
| 5,622,341 | A * | 4/1997 | Stana | 248/74.1 |
| 6,174,177 | B1 * | 1/2001 | Auclair | 439/100 |
| 6,280,264 | B1 * | 8/2001 | Whipple et al. | 439/814 |
| 6,293,830 | B1 * | 9/2001 | Park et al. | 439/801 |

(Continued)

*Primary Examiner* — Amy Cohen Johnson
*Assistant Examiner* — Vladimir Imas

(57) ABSTRACT

An intersystem grounding clamp including two clamp halves with flat mating surfaces at their ends and a recessed area at their centers. The recessed areas include teeth thereon to form opposing serrated gripping surfaces for securely gripping a water pipe or grounding rod. Through holes and clamping screws are provided through the clamp halves at the flat mating surfaces to connect the clamp halves in a clamping assembly and enable tightening of the grounding clamp to a pipe or rod. The clamp halves include a first clamp half and a second clamp half. The second clamp half includes a plurality of grounding terminals thereon for accepting grounding wires from equipment. The grounding terminals include open bores laterally through the second clamp half and threaded terminal screws screwed into the second clamp half and oriented to intersect the open bores.

15 Claims, 7 Drawing Sheets

(56) References Cited

U.S. PATENT DOCUMENTS

| | | | | |
|---|---|---|---|---|
| 6,305,991 | B1 * | 10/2001 | Gerster | 439/801 |
| 6,722,929 | B2 * | 4/2004 | Vincent et al. | 439/801 |
| 6,743,029 | B1 * | 6/2004 | Greene et al. | 439/107 |
| 6,855,012 | B2 * | 2/2005 | An | 439/793 |
| 6,905,375 | B2 * | 6/2005 | Ikeda | 439/801 |
| 6,976,857 | B1 * | 12/2005 | Shukla et al. | 439/100 |
| 6,986,673 | B2 * | 1/2006 | de la Borbolla | 439/100 |
| 7,056,163 | B2 * | 6/2006 | Hay | 439/810 |
| 7,537,467 | B1 * | 5/2009 | Gretz | 439/108 |
| 7,621,763 | B2 * | 11/2009 | Clark et al. | 439/100 |
| 7,637,754 | B1 * | 12/2009 | Yerena et al. | 439/108 |
| 7,780,461 | B1 * | 8/2010 | Vernica | 439/100 |
| 7,922,546 | B1 | 4/2011 | Smith et al. | |
| 7,942,679 | B1 * | 5/2011 | Gretz | 439/108 |
| 7,963,811 | B2 * | 6/2011 | Wason et al. | 439/798 |
| 8,021,169 | B1 * | 9/2011 | Smith | 439/100 |
| 8,177,563 | B1 * | 5/2012 | Vernica | 439/100 |
| 8,192,210 | B2 * | 6/2012 | Gardner et al. | 439/100 |
| 8,277,263 | B1 * | 10/2012 | Smith | 439/779 |
| 8,317,526 | B2 * | 11/2012 | Gardner et al. | 439/100 |
| 8,449,308 | B2 * | 5/2013 | Smith | 439/100 |
| 8,579,655 | B2 * | 11/2013 | Kawamura | 439/509 |

* cited by examiner

INTERSYSTEM GROUNDING CLAMP WITH SERRATED GRIPPING SURFACES AND A PLURALITY OF GROUNDING TERMINALS

FIELD OF THE INVENTION

This invention relates to the grounding of electrical service equipment and specifically to an improved intersystem grounding clamp with serrated pipe gripping surfaces and a plurality of sites for connection of grounding and bonding conductors of other service equipment.

BACKGROUND OF THE INVENTION

Electrical service panels and other electrical equipment must be properly grounded to assure continuity for the equipment. When available, a metal underground water pipe is typically used as a grounding electrode. A grounding device is preferably connected to the water pipe to serve as a common grounding point for the electrical equipment. In addition, all interior metallic water and gas piping which may become energized must be bonded together and made electrically continuous with the grounding electrode.

Although various devices have been proposed for providing a grounding connection to a metal underground water pipe, it is important to provide a secure connection of the grounding device to the pipe in order to achieve electrical continuity between the grounding device and the pipe. Furthermore, with the increase in the number of electrical devices and components that require proper grounding, it is important to provide an adequate number of bonding sites on the grounding device to accept grounding and bonding connectors from the various pieces of equipment.

These and other advantages will become apparent by reading the attached specification and claims in conjunction with reference to the attached drawings.

SUMMARY OF THE INVENTION

The present invention is an intersystem grounding clamp including two clamp halves with flat mating surfaces at their ends and a recessed area at their centers. The recessed areas include teeth thereon to form opposing serrated gripping surfaces for securely gripping a water pipe or grounding rod. Through holes and clamping screws are provided through the clamp halves at the flat mating surfaces to connect the clamp halves in an adjustable clamping assembly and enable tightening of the grounding clamp to a pipe or rod. The clamp halves include a first clamp half and a second clamp half. The second clamp half includes a plurality of grounding terminals thereon for accepting grounding wires from equipment. The grounding terminals include open bores laterally through the second clamp half and threaded terminal screws screwed into the second clamp half and oriented to intersect the open bores.

OBJECTS AND ADVANTAGES

Several advantages are achieved with the intersystem grounding clamp of the present invention, including:

(1) Clamp halves include recessed areas with opposing serrated gripping surfaces to provide a secure grip on a pipe or rod.

(2) The intersystem grounding clamp includes at least four intersystem bonding or grounding terminals to provide adequate grounding terminations for various electrical equipment.

(3) Each clamp half is die cast in one piece, thereby ensuring good electrical continuity throughout each clamp half.

(4) The entire intersystem grounding clamp assembly is of all metal construction thereby providing improved grounding and electrical continuity between the clamp and all service equipment enclosures to which it is connected.

(5) The open bores of the intersystem bonding terminals are capable of accepting grounding wires from 14 through 4 awg (American Wire Gauge).

(6) The serrated gripping surfaces of the grounding clamp can accommodate a wide range of pipes and rods including nominal pipe diameters half inch, ¾, and 1-inch and ground rods of nominal diameters half inch, or ⅝-inch.

These and other objects and advantages of the present invention will be better understood by reading the following description along with reference to the drawings.

DETAILED DESCRIPTION OF THE INVENTION

Figure 1:
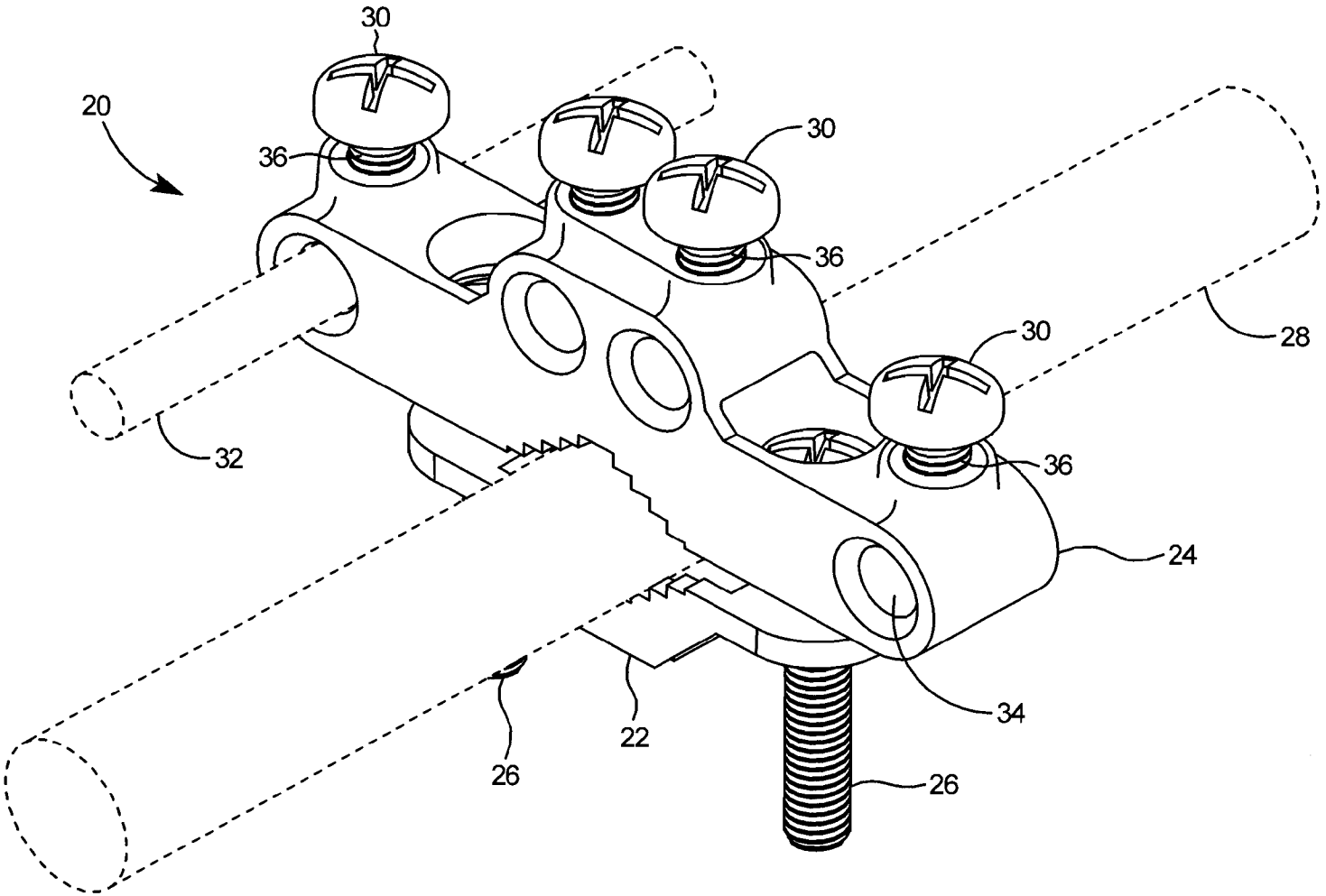
FIG. 1 is a perspective view of a first embodiment of an intersystem grounding clamp according to the present invention.
Figure 2:
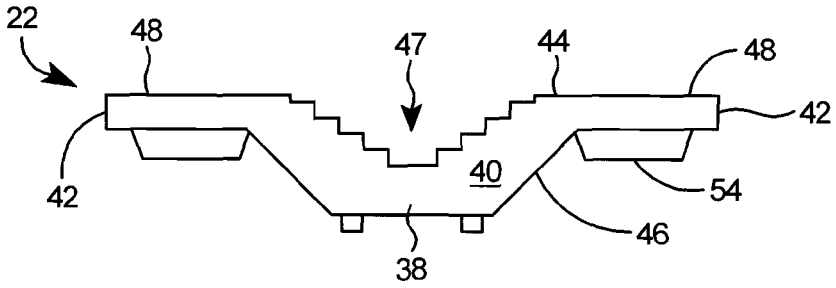
FIG. 2 is a side view of a first clamp half that forms a portion of the intersystem grounding clamp of FIG. 1.
Figure 3:
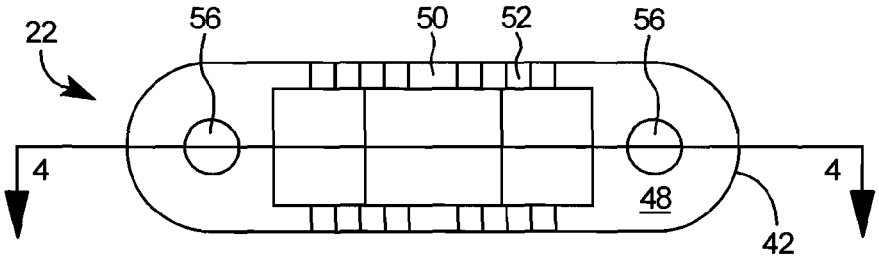
FIG. 3 is a top view of the first clamp half or as viewed from the top side of FIG. 2.

With reference to FIG. 1 there is shown an exploded view of the preferred embodiment of an intersystem grounding clamp 20 according the present invention. The intersystem grounding clamp 20 includes two mating clamp halves including a first clamp half 22, a second clamp half 24, and clamping screws 26 for holding the clamp halves 22 and 24 together in an adjustable clamping assembly or for tightening the clamp halves onto a grounding object such as a pipe or rod 28 as shown in the figure. The second clamp half 24 includes a plurality of grounding terminals 30 for accepting grounding wires 32 from interservice equipment. The grounding terminals 30 include open bores 34 laterally through the second clamp half 24 and threaded terminal screws 36 screwed into the second clamp half and oriented to intersect the open bores 34.

Figure 4:
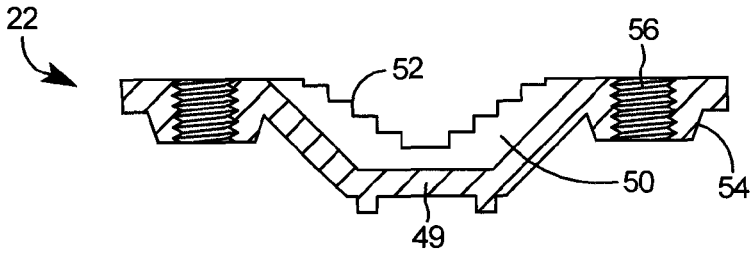
FIG. 4 is a sectional view of the first clamp half taken along line 4-4 of FIG. 3.
Figure 6:
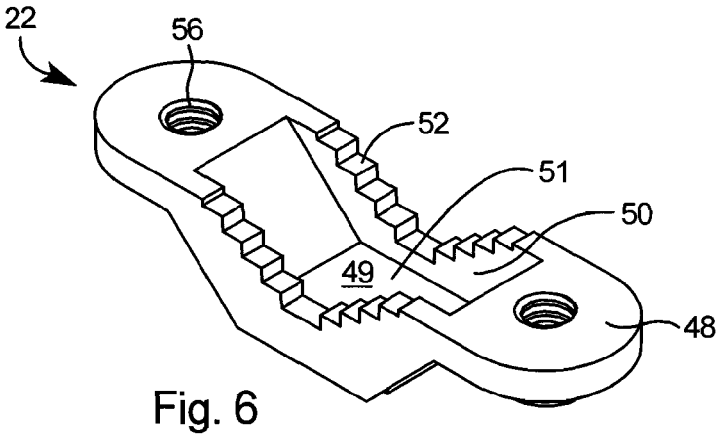
FIG. 6 is a perspective view of the first clamp half.
Figure 5:
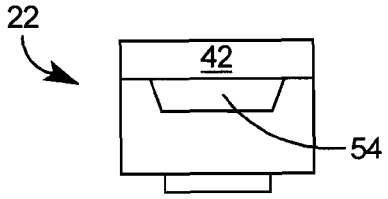
FIG. 5 is an end view of the first clamp half.

Referring to FIGS. 2-6, the first clamp half 22 is preferably of one-piece construction and includes a body 38 with two lateral sides 40, two ends 42, a facing side 44, and a distal side 46. A flat mating surface 48 is included on the facing side 44 of the body 38 at each end 42 and a recessed area 47 is included between the flat mating surfaces 48. As shown in FIG. 4, the body 38 includes a base 49 and two parallel ridges 50 extending from opposing sides of the base 49 and are oriented longitudinally along the body 38. As shown in FIG. 6, the ridges 50 form a pocket 51 above the base 49 in the first clamp half 22. The ridges 50 include teeth 52 thereon. Bosses 54 extend from the distal side 46 at each end 42 of the body 38 and a threaded bore 56 extends through each end 42 of the body and through each of the bosses 54. Most preferably there are at least 10 teeth per inch of length of ridge 50.

Figure 7:
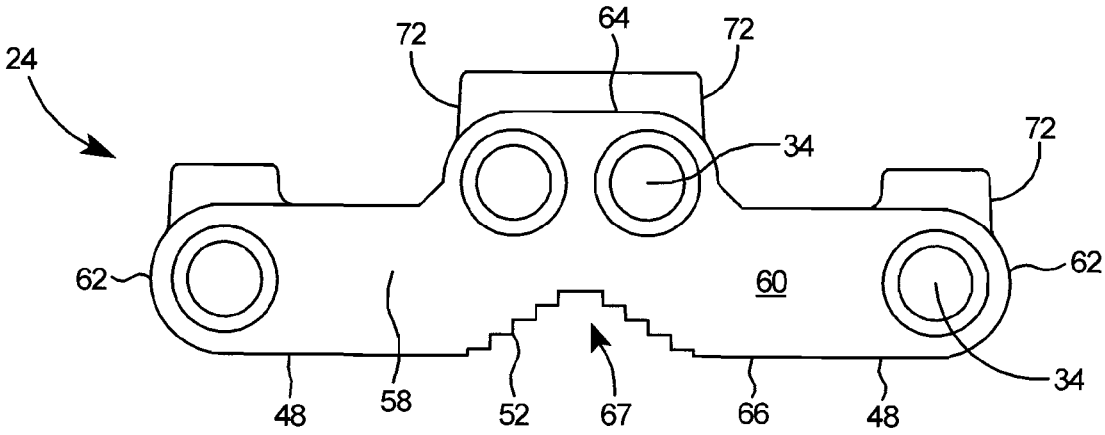
FIG. 7 is a side view of a second clamp half that forms a portion of the intersystem grounding clamp of FIG. 1.
Figure 8:
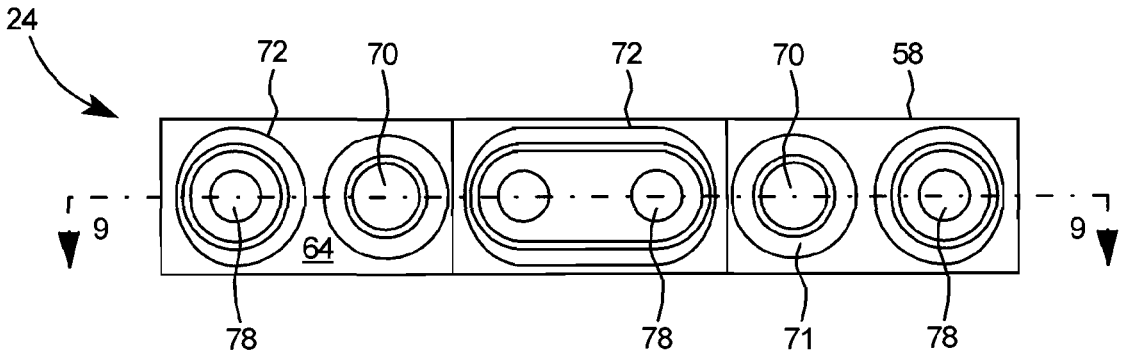
FIG. 8 is a top view of the second clamp half or as viewed from the top side of FIG. 7.
Figure 9:
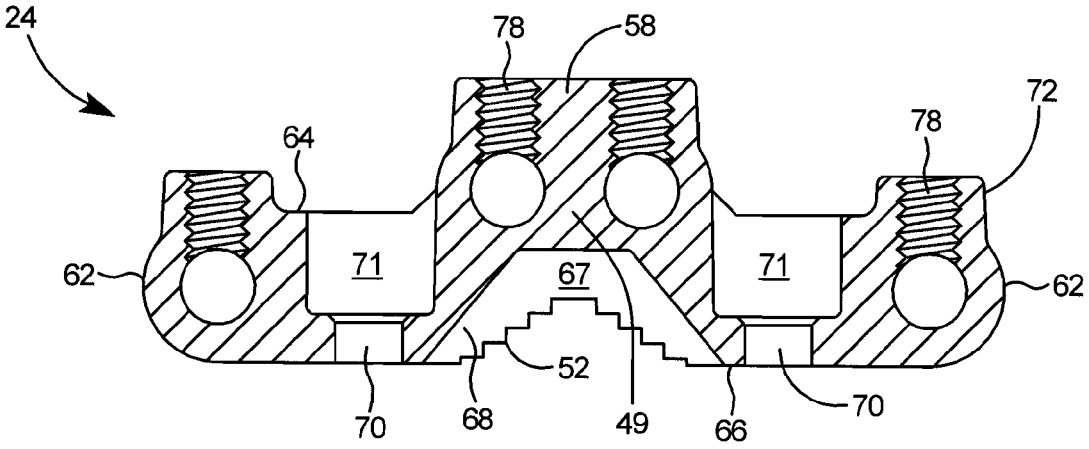
FIG. 9 is a sectional view of the second clamp half taken along line 9-9 of FIG. 8.
Figure 10:
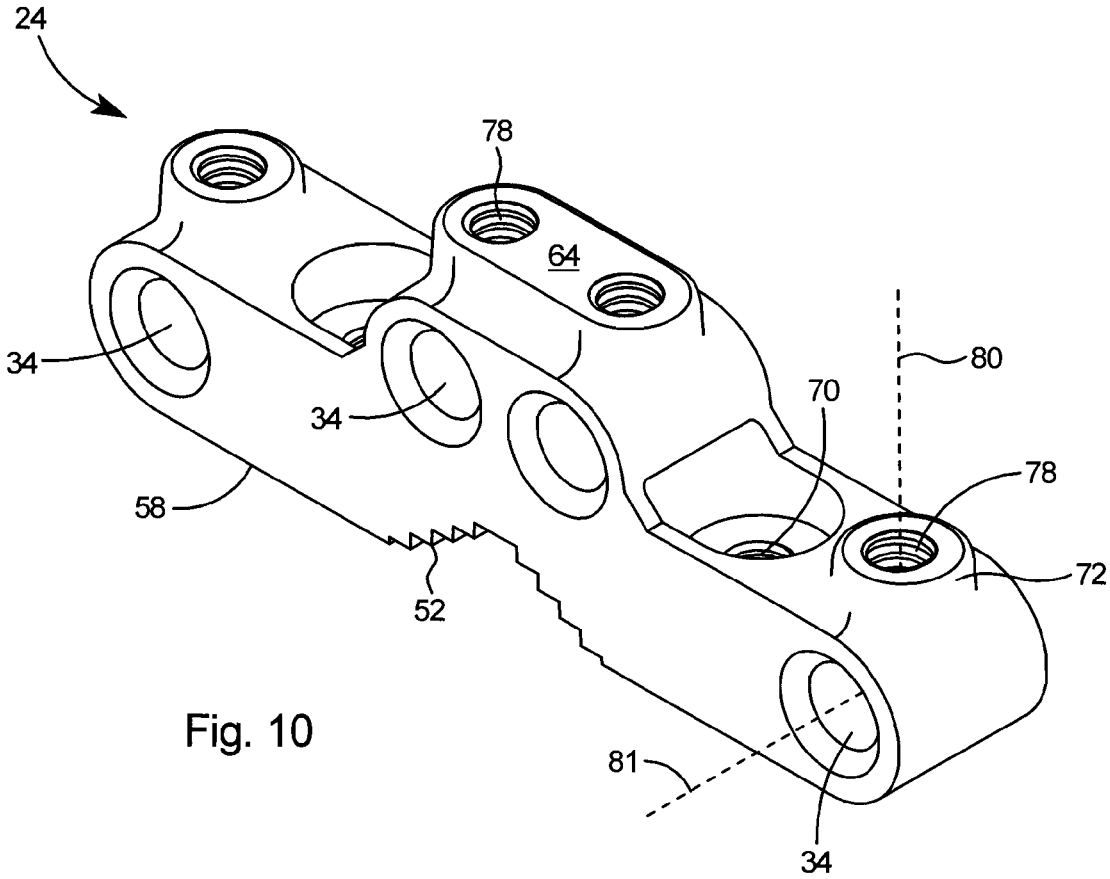
FIG. 10 is a perspective view of the second clamp half.

With reference to FIGS. 7-10, the second clamp half 24 is preferably of one-piece construction and includes a body 58 with two lateral sides 60, two ends 62, a distal side 64, and a facing side 66. A flat mating surface 48 is included on the facing side 66 of the body 58 substantially near each end 62. As shown in FIG. 9, a recessed area 67 is provided in the facing side 66 of the body 58 substantially centered between the two ends 62. The recessed area 67 is formed by two parallel ridges 68, one of which is shown in FIG. 9, extending from opposing sides of the body 58 and is oriented longitudinally along the body. The ridges 68 include teeth 52 thereon. Smooth bores 70 extend through the body 58 in from distal side 64 to facing side 66 in two places as shown in FIGS. 8 and 9. The smooth bores 70 include a wide entry bore 71 extending a substantial distance into the body 58. The wide entry bores 71 provide a recessed area for later accommodating the heads of the clamping screws (not shown) when the two clamp halves are formed into a clamping assembly. As shown in FIG. 7, bosses 72 extend from the distal side 64 at substantially the center 74 and at the two ends 62 of the body, with the bosses 72 aligned with the open bores 34. As shown in FIGS. 9 and 10, the second clamp half 24 includes a plurality of open bores 34 extending laterally through the body 58. A threaded bore 78 is provided in the distal side 64 extending into each of the bosses 72. As shown in FIG. 9, the threaded bores 78 extend through the body 58 to the open bores 34. The axis 80 of each threaded bore 78 is substantially perpendicular to the axis 81 of the respective open bore 34 that it joins.

Figure 11:
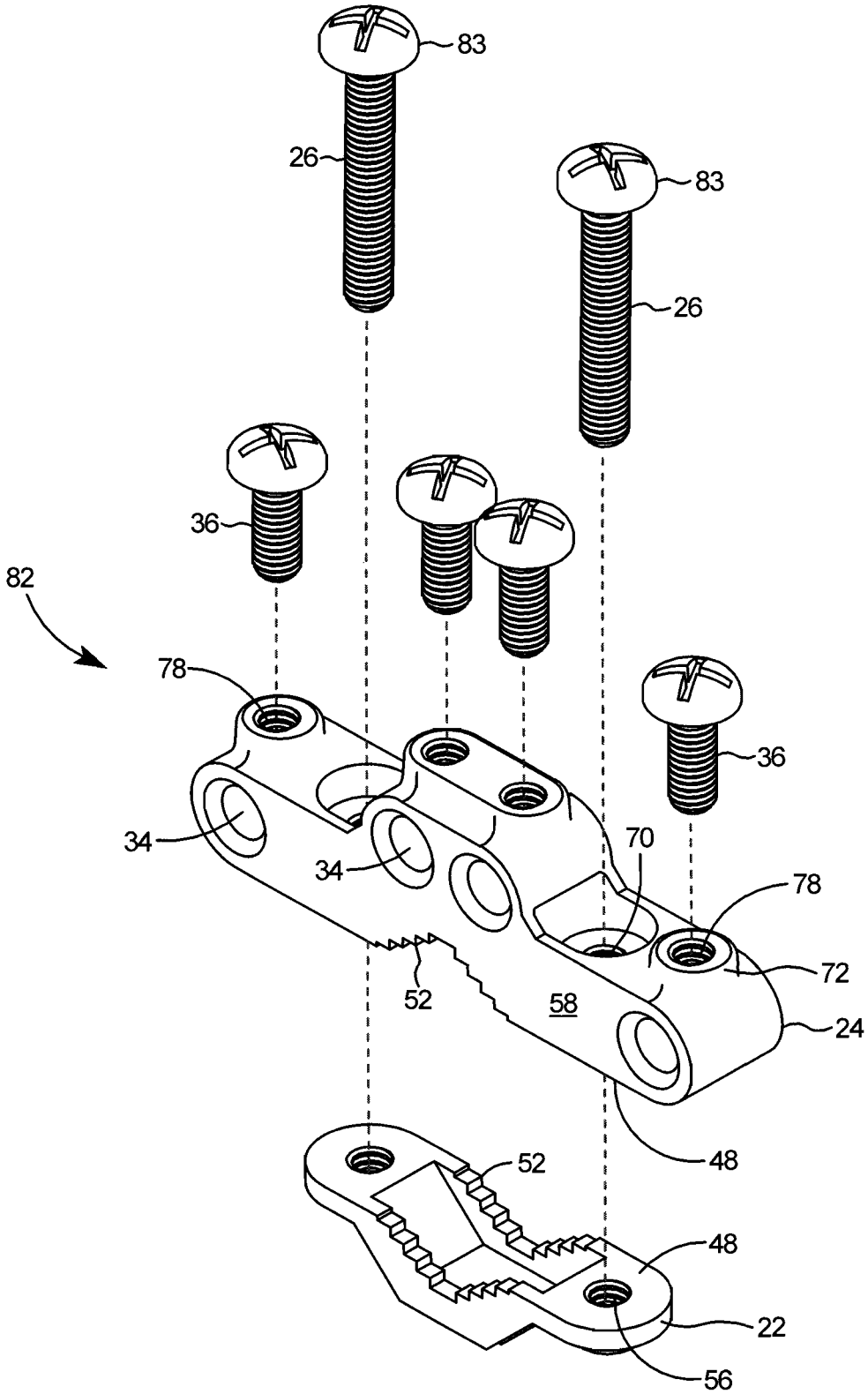
FIG. 11 is an exploded perspective view of the first embodiment of the intersystem grounding clamp depicted in FIG. 1.

With reference to FIG. 11, the clamping screws 26 extend through the smooth bores 70 in the second clamp half 24 and thence are threaded into threaded bores 56 in the first clamp half 24 to form the two clamp halves 22 and 24 into a clamping assembly 82. The clamping screws 26 are adapted to turn freely in the smooth bores 70 of the second clamp half 24 and engage the threaded bores 56 in the first clamp half 22 thereby enabling adjustment of the first clamp half 22 with respect to the second clamp half 24. Clamping screws 26 include heads 83. Threaded terminal screws 36 are screwed into the second clamp half 24 and oriented to intersect the open bores 34 extending laterally through the body 58 of the second clamp half 24.

Figure 12:
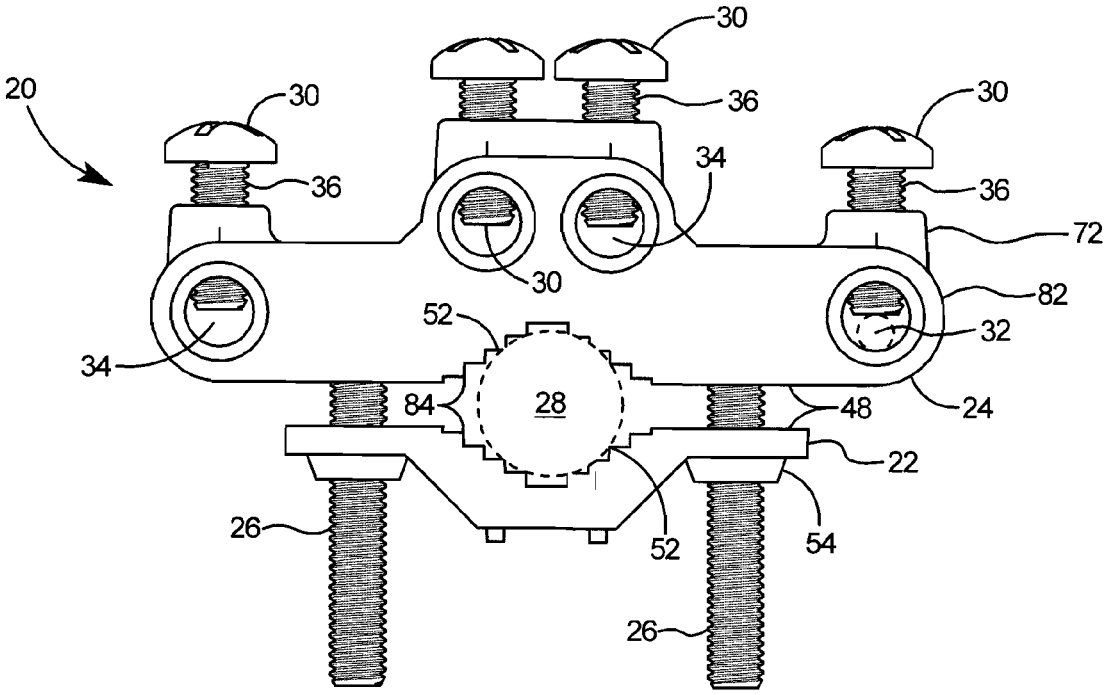
FIG. 12 is a side view of the intersystem grounding clamp assembly.
Figure 13:
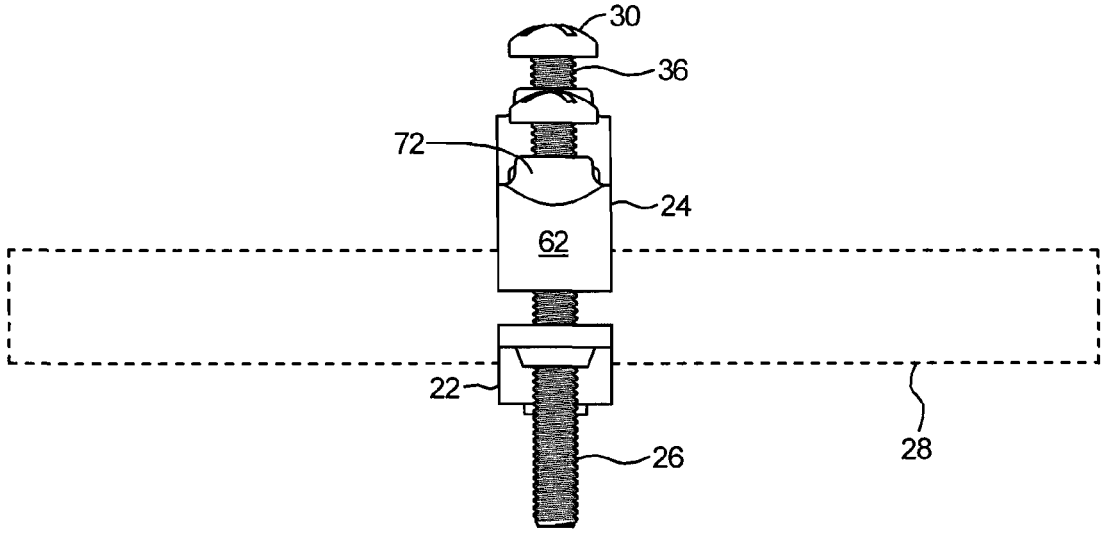
FIG. 13 is a side view of the intersystem grounding clamp assembly.

As shown in FIG. 12, the assembled clamping assembly 82 forms the first embodiment of an intersystem grounding clamp 20 of the present invention. The teeth 52 on the clamp halves 22 and 24 form opposing serrated gripping surfaces 84 on the grounding clamp 20. In operation, the clamping screws 26 can be rotated to open the 10 grounding clamp 20 in order to slip the clamp over a suitable grounding pipe or rod 28, after which the clamping screws 26 are tightened to firmly close the serrated gripping surfaces 84 of the clamp 20 onto the grounding pipe or rod. The serrated gripping surfaces 84 enable the grounding clamp 20 to accommodate pipe diameters of trade size half inch, ¾ inch, and 1-inch. By flipping the first clamp half 22 with respect to the second clamp 15 half 24, the grounding clamp 20 can also accommodate ground rods of trade size half inch or ⅝-inch also. After the two clamp halves 22 and 24 are assembled into the clamping assembly 82 as shown in FIG. 12, the heads 83 of clamping screws 26 are recessed within the wide entry bores 71 (see FIG. 11) of the second clamp half 24 and therefore are out of sight in the side view of the clamp 20.

The second clamp half 24 includes a plurality of grounding terminals 30 for accepting grounding wires 32 from equipment. The grounding terminals 30 include the open bores 34 extending laterally through the second clamp half 24 and threaded terminal screws 36 screwed into the second clamp half and oriented to intersect the open bores 34. Four grounding terminals 30 are provided in the first embodiment of the intersystem grounding clamp 20. In operation, to secure a grounding wire 32 to the grounding clamp 20, the installer simply retracts one of the threaded terminal screws 36, extends the grounding wire 32 through the open bore 34, and then tightens the terminal screw 36 to secure the grounding wire to the intersystem grounding clamp 20. Up to four grounding wires can be secured to the grounding clamp 20. The open bores 34 of the intersystem grounding terminals 30 are capable of accepting a wide range of grounding wires or conductors including a range of from 14 awg to 4 awg conductors.

Figure 14:
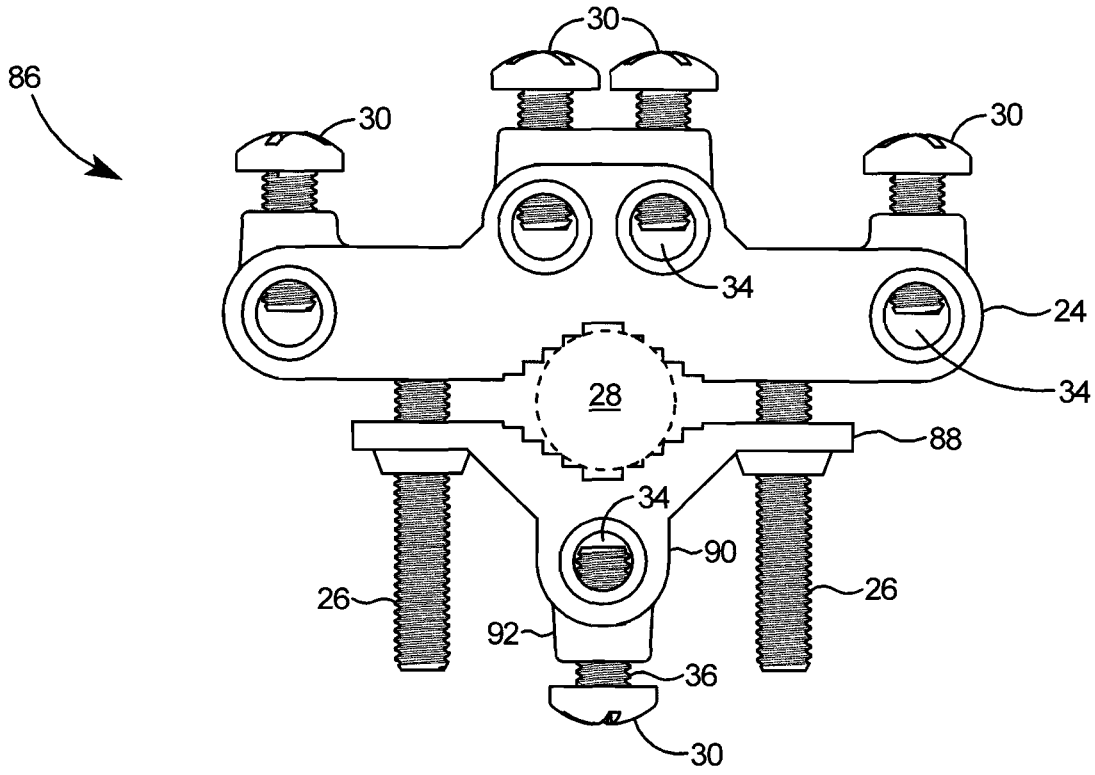
FIG. 14 is a perspective view of a second embodiment of an intersystem grounding clamp according to the present invention.
Figure 15:
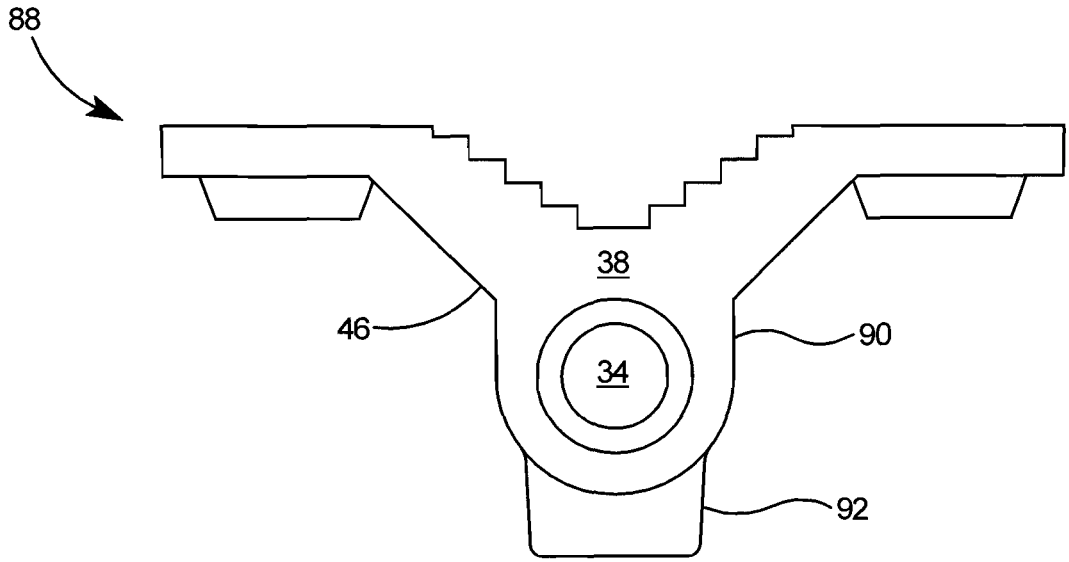
FIG. 15 is a side view of a second clamp half that forms a portion of the intersystem grounding clamp of FIG. 14.

With reference to FIG. 14 there is shown a second and preferred embodiment of an intersystem grounding clamp 86 according to the present invention. Intersystem grounding clamp 86 is substantially similar to the first embodiment but includes a modified first clamp half 88. The first clamp half 88 includes an arm 90 extending from the distal side 46 of the clamp body 38. With reference to FIGS. 14 and 15, the arm 90 of the first clamp half 88 includes an open bore 34 extending laterally there through, a boss 92 extending from the arm 90, and a threaded terminal screw 36 screwed into the boss 92 and oriented to intersect the open bore 34. The open bore 34 and terminal screw 36 thereby forms a grounding terminal 30 on the first clamp half 88. Intersystem grounding clamp 86 therefore includes five grounding terminals 30 for accommodating up to five grounding wires and thereby providing increased grounding functionality over the first embodiment.

The one-piece clamp halves 22 and 24 are preferably each constructed of metal. Most preferably the material of construction of the clamp halves is bronze or zinc alloy. The zinc alloy is preferably ZAMAK™, a casting alloy comprised mainly of zinc alloyed with aluminum, magnesium, and copper and available from Eastern Alloys, Maybrook, N.Y. By constructing the clamp halves of bronze, zinc alloy, or other electrically conductive metals, the clamp halves 22 and 24 will be electrically conductive and provide good continuity throughout the clamp assembly. The clamping screws 26 and terminal screws 36 are also constructed of metal, thereby making the entire intersystem grounding clamp assemblies of the present invention electrically conductive and thereby insuring good electrical conductivity between the clamp halves, the clamping screws 26, the terminal screws 36, the pipe or rod the clamp is secured to, and all wire conductors secured to the grounding terminals 30. Bronze construction qualifies the clamp assembly to meet most electrical codes for direct ground burial.

Although the description above contains many specific descriptions, materials, and dimensions, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A grounding clamp comprising:

two mating clamp halves including a first clamp half and a second clamp half, each of said clamp halves including a body having a facing side, a distal side, two lateral sides, and two ends;

said facing sides of said clamp halves including flat mating surfaces and a recessed area between said flat mating surfaces;

a serrated gripping surface on said facing side of each of said clamp halves;

clamping screws through said bodies of said clamp halves for holding said clamp halves together in an adjustable clamping assembly;

said distal side of said second clamp half including a plurality of grounding terminals for accepting secure attachment of grounding wires thereto;

said first clamp half includes an arm extending from said distal side of said clamp body;

an open bore extending laterally through said arm on said first clamp half;

a grounding terminal screw in said arm and oriented to intersect said open bore of said arm;

said grounding terminals of said second clamp half and said grounding terminal of said arm of said first clamp half oriented toward said facing sides of said clamp halves;

said clamping screws include heads;

said smooth bores of said second clamp half include a wide entry bore extending from said distal side of said second clamp half, said wide entry bore adapted to accommodate said heads of said clamping screws of said adjustable clamping assembly;

open bores extending laterally through said body of said second clamp half; and bosses extending from said distal side of said second clamp half, said bosses aligned with said open bores extending laterally through said body.

2. The grounding clamp of claim 1 wherein said second clamp half includes smooth bores extending through said body;

said first clamp half includes threaded bores extending through said body; and said clamping screws are adapted to turn freely in said smooth bores of said second clamp half and engage said threaded bores in said first clamp half thereby enabling adjustment of said first clamp half with respect to said second clamp half.

3. The grounding clamp of claim 1 wherein said serrated gripping surfaces include two parallel ridges and a plurality of teeth on said ridges.

4. The grounding clamp of claim 3 wherein each of said bodies of said clamp halves include a base; and said parallel ridges extend from opposing sides of said base and are oriented longitudinally along said body.

5. The grounding clamp of claim 1 wherein said grounding terminals include threaded terminal screws screwed into said second clamp half and oriented to intersect said open bores.

6. The grounding clamp of claim 1 wherein said grounding clamp includes at least four of said grounding terminals.

7. The grounding clamp of claim 2 wherein said first clamp half includes bosses extending from said distal sides of said body; and said threaded bores of said first clamp half extend through said bosses.

8. The grounding clamp of claim 3 wherein said plurality of teeth on said ridges includes at least 10 teeth per inch of length of said ridges.

9. The grounding clamp of claim 1 wherein said clamp halves are constructed of metal.

10. The grounding clamp of claim 1 wherein the material of construction of said clamp halves are selected from the group including bronze and zinc alloy.

11. The grounding clamp of claim 1 wherein said serrated gripping surfaces of said 5 clamp halves will accommodate pipe diameters of trade size ½, ¾, and 1-inch.

12. The grounding clamp of claim 5 wherein said open bores of said grounding terminals are capable of accepting grounding wires of size 14 awg to 4 awg.

13. The grounding clamp of claim 1 including a boss extending from said arm; and said threaded terminal screw extends through said boss and said arm.

14. The grounding clamp of claim 5 wherein said second clamp half includes a plurality of threaded bores in said distal side of said clamp body for accepting said threaded terminal screws; and said threaded bores extend through said clamp body to said open bores.

15. The grounding clamp of claim 14 wherein each of said threaded bores is perpendicular to its corresponding open bore.

* * * * *